US006213091B1

(12) United States Patent
Haugen

(10) Patent No.: US 6,213,091 B1
(45) Date of Patent: Apr. 10, 2001

(54) ENGINE COMPRESSION BRAKE SYSTEM

(75) Inventor: David James Haugen, Waterloo, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 09/528,936

(22) Filed: Mar. 21, 2000

(51) Int. Cl.[7] ..... F02D 13/04
(52) U.S. Cl. ..... 123/321
(58) Field of Search ..... 123/321, 90.43

(56) References Cited

U.S. PATENT DOCUMENTS

| | | | | |
|---|---|---|---|---|
| 3,367,312 | | 2/1968 | Jonsson | 123/97 |
| 3,809,033 | | 5/1974 | Cartledge | 123/90.46 |
| 4,572,114 | | 2/1986 | Sickler | 123/21 |
| 4,643,141 | | 2/1987 | Bledsoe | 123/90.16 |
| 4,723,516 | | 2/1988 | Slagley et al. | 123/90.16 |
| 5,335,636 | | 8/1994 | Bilei et al. | 123/321 |
| 5,611,308 | * | 3/1997 | Hackett | 123/321 |
| 5,645,031 | * | 7/1997 | Meneely | 123/321 |
| 5,647,319 | | 7/1997 | Uehara et al. | 123/322 |
| 6,012,424 | * | 1/2000 | Meistrick | 123/321 |

* cited by examiner

*Primary Examiner*—John Kwon

(57) ABSTRACT

An engine compression braking system includes an exhaust rocker arm pivotally supported on rocker shaft. One end of the rocker arm carries a roller which engages a camshaft which has a lost motion bump formed thereon. The other end of the rocker arm engages an exhaust valve stem assembly. A part of the rocker shaft engages a pressure operated piston. Extension of the piston moves the rocker shaft transversely to its axis, so that the rocker arm can selectively react to or ignore the lost motion portion bump. A pressure control system includes a solenoid operated valve controlled by an operator controlled switch, so that the piston selectively applies a light force or a very high force to the rocker arm rocker shaft, thus controlling the pivot point of the rocker arm.

7 Claims, 1 Drawing Sheet

ENGINE COMPRESSION BRAKE SYSTEM

BACKGROUND OF THE INVENTION

The invention relates to an engine compression brake system, and particularly, to an engine compression brake system of the type wherein the pivot center of the exhaust rocker arm is displaced.

Various types of engine compression brake systems are known. In one type of engine compression brake system, a lost motion device is included in an end of the rocker arm or in the links connecting the rocker arm to the cam lobe or valve (push rod or lifter) to allow a control mechanism to react to or ignore a portion of the cam lobe profile. Another type of engine compression brake system is shown in U.S. Pat. No. 5,647,319, issued in 1997 to Uehara et al. and U.S. Pat. No. 3,367,312, issued in 1966 to Jonsson. Both of these systems have engine brake mechanisms wherein the pivot center of the exhaust rocker arm is displaced or shifted by an eccentric which is connected to an hydraulic piston/actuator by a lever arm.

However, these mechanisms require an extra mechanical component between the hydraulic piston/actuator and the rocker arm. Also, the various actuation arms and levers of these systems are subject to tension and bending loads, which increases the probability of stress failures. These additional links, arms and actuators also increase the manufacturing tolerance requirements of many of the components. These systems also require intermediate arms, a second rocker arm eccentric bore, features on the small end of the actuation/pivot arm and features on the mechanical actuation end of the piston. These parts and features all add cost and complexity, and reduce system reliability. Finally, these systems result in an assembly which is not as compact as desired, and could result in increased engine height.

SUMMARY OF THE INVENTION

Accordingly, an object of this invention is to provide an engine compression brake mechanism with few components.

A further object of the invention is to provide such an engine compression brake mechanism wherein the parts are not subject to tension and bending loads.

A further object of the invention is to provide such an engine compression brake mechanism which does not increase the manufacturing tolerance requirements of many of the components.

A further object of the invention is to provide such an engine compression brake mechanism with reduced complexity, lower cost and increased system reliability.

A further object of the invention is to provide such an engine compression brake mechanism which avoids increasing engine height.

These and other objects are achieved by the present invention, wherein an engine compression braking system includes an exhaust rocker arm pivotally supported on a rocker shaft. One end of the rocker arm carries a roller which engages a camshaft which has a lost motion bump formed thereon. The other end of the rocker arm engages an exhaust valve stem assembly. A part of the rocker shaft engages a pressure operated piston. Extension of the piston moves the rocker shaft transversely to its axis, so that the rocker arm can selectively react to or ignore the lost motion portion bump. A pressure control system includes a solenoid operated valve controlled by an operator controlled switch, so that the piston selectively applies a light force or a very high force to the rocker arm rocker shaft, thus shifting the pivot point of the rocker arm

BRIEF DESCRIPTION OF THE DRAWINGS

The sole FIGURE is a view of an engine compression braking system according to the present invention.

DETAILED DESCRIPTION

Figure 1:
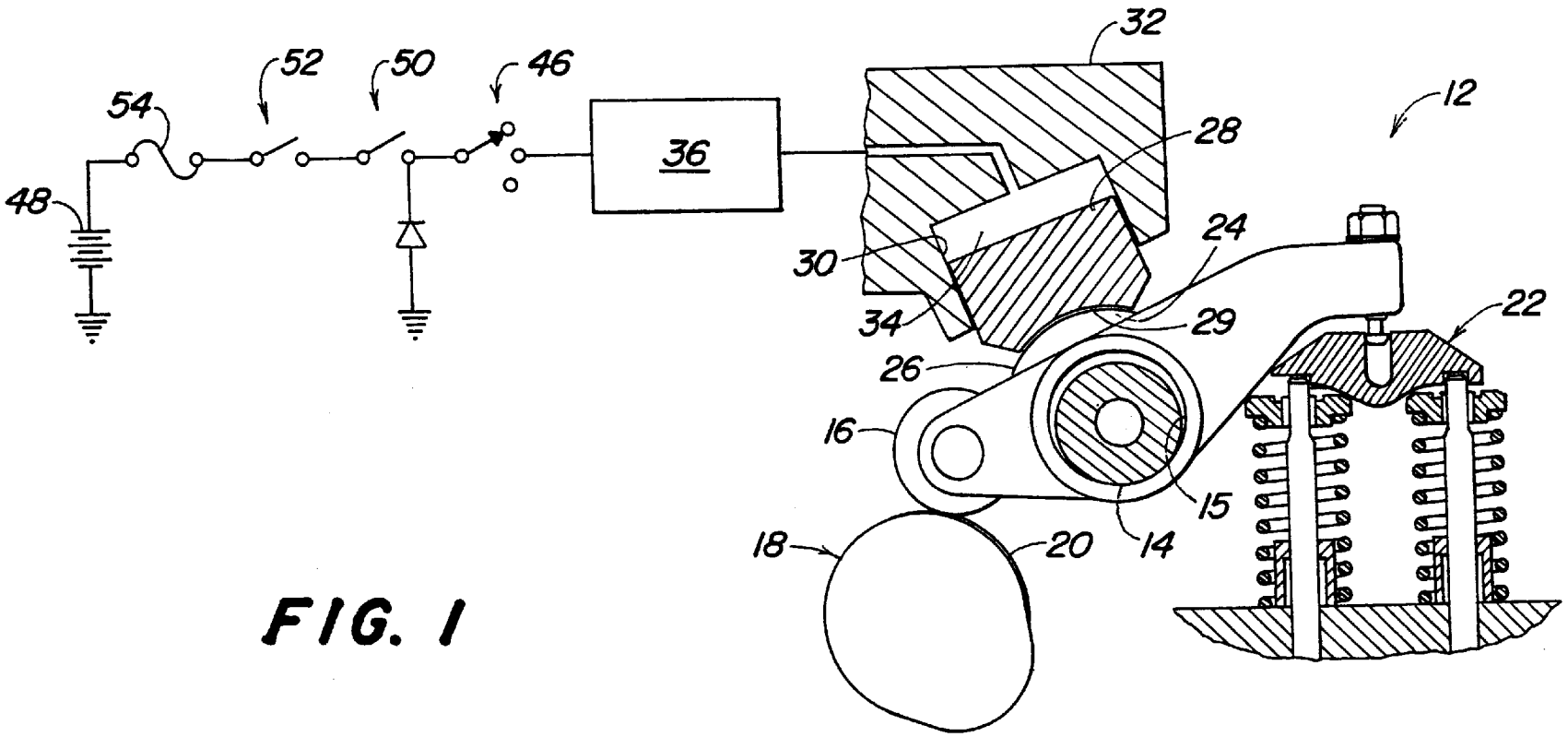

Referring to the sole FIGURE, the engine compression braking system 10 includes an exhaust rocker arm 12 pivotally supported by rocker shaft 14 which is received by rocker shaft bore 15. The rocker shaft 14 has a diameter which is smaller than that of the rocker shaft bore 15 by a small amount such as 0.030 inches. One end of the rocker arm 12 carries a roller 16 which engages a camshaft 18 which has a lost motion bump 20 formed thereon. The other end of the rocker arm 12 engages an exhaust valve stem assembly 22. Because of the bias of the springs of the valve stem assembly 22, normally, the rocker arm 12 will be in engagement with the bottom side of the rocker shaft 14, viewing the Figure. The rocker arm 12 includes a tab 24 which projects therefrom. The tab 24 has partially cylindrical convex outer surface 26. A piston 28 engages the tab 24 and has cylindrical concave surface 29 which mates with the convex surface 26 of tab 24. As clearly shown in the sole FIGURE, the piston 28 slides along an axis which extends through the rocker shaft 14.

The piston 28 is slidably received in a piston bore 30 formed in a housing 32, which is preferably part of the piston housing of a Diesel engine (not shown). The piston 28 and a wall of the bore 30 enclose a pressure chamber 34. The pressure in chamber 34 is preferably controlled by a pressure control assembly 36, preferably also enclosed in the housing 32, such as is known from "FAQs: Engine Brake Theory", by Jacobs Vehicle Systems, 1996.

The pressure control assembly 36 preferably includes a solenoid operated valve (not shown), and energization of the solenoid valve is controlled by an operator controlled switch 46, which is preferably connected to the vehicle battery 48 via a fuel pump switch 50, clutch switch 52 and fuse 54. Pressurization of the pressure chamber 34 causes the piston 28 to move towards the rocker shaft 14 and thereby moves the central portion of the rocker arm 12 until the wall of bore 15 engages an upper part of the rocker shaft 14, thus shifting the pivot axis of the rocker arm 12.

Thus, this system 10 uses electronically controlled hydraulics to control the pivot position the exhaust rocker arm 12 for engine retarding or braking. Controlling the pivot position of the exhaust rocker arm 12 allows the selective transfer of some or all the exhaust lobe profile/motion of the camshaft 18 to be transferred to the exhaust valve stem assembly 22. The selective transfer of some or all the cam lobe motion to the valves, in conjunction with engine fueling level, determines the engines capability to generate positive power or absorb (braking) power.

Extension of the piston 28 moves the rocker arm pivot point transversely to its axis, so that the rocker arm 12 can selectively react to or ignore the lost motion bump 20. The pressure on the piston 28 can be controlled so that the piston 28 selectively applies a light force or a very high force to the rocker arm 12, thus controlling the pivot point of the rocker arm 12. A light piston force allows the rocker arm 12 to operate in its normal location, such as when the engine (not shown) is under load. This normal position prevents the rocker arm 12 from reacting to the lost motion bump 20, and transmitting forces to the exhaust valve assembly 22, since the lost motion bump 20 is small enough to be "lost" in the valve lash clearance. A high piston force displaces and holds the rocker arm 12 down against the top of the rocker shaft 14, causing the rocker arm 12 to react to the lost motion bump 20, and transmit forces to the exhaust valve assembly 22, since the rocker arm 12 has an effective zero valve lash clearance.

The system above does not have an extra mechanical component between the hydraulic piston/actuator and the rocker arm, resulting in improved function, reliability and reduced cost. Since the piston 28 exerts only a compressive force on the rocker arm 12, bending loads are avoided and the probability of failure is reduced. Fewer parts results in lowered manufacturing tolerance requirements components other than the hydraulic piston/bore and the rocker arm bore. Finally, this design permits a compact engine of low height.

While the present invention has been described in conjunction with a specific embodiment, it is understood that many alternatives, modifications and variations will be apparent to those skilled in the art in light of the foregoing description. Accordingly, this invention is intended to embrace all such alternatives, modifications and variations which fall within the spirit and scope of the appended claims.

What is claimed is:

1. In an engine compression braking system having a rocker arm pivotally supported on a rocker shaft, a pressure responsive piston operatively coupled to the rocker arm, and a pressure control system for controlling fluid pressure applied to the piston, movement of the piston causing movement of a pivot axis of the rocker arm, characterized by:

the rocker arm having a pivot bore which receives the rocker shaft, the pivot bore having a diameter which is larger than a diameter of the pivot shaft; and the piston having an end face which directly engages a portion of the rocker arm, and the piston being slidable along an axis which extends through the pivot shaft.

2. The engine compression braking system of claim 1, wherein:

the rocker arm includes a tab which projects therefrom and engages the end face of the piston.

3. The engine compression braking system of claim 1, wherein:

the rocker arm includes a tab which projects therefrom, the tab having a curved convex outer surface; and the piston having a curved concave surface which matingly engages the convex surface of tab.

4. The engine compression braking system of claim 1, wherein:

normally, the rocker arm will be in engagement with a bottom portion of the rocker shaft, and pressurization of the pressure chamber causing the piston to move the rocker arm into engagement with an upper part of the rocker shaft.

5. In an engine compression braking system having a rocker arm pivotally supported on a rocker shaft, a pressure responsive piston operatively coupled to the rocker arm, and a pressure control system for controlling fluid pressure applied to the piston, movement of the piston causing movement of a pivot axis of the rocker arm, characterized by:

the rocker arm having a pivot bore which receives the rocker shaft, the pivot bore having a diameter which is larger than a diameter of the pivot shaft; and the rocker arm normally engaging a first side of the rocker shaft, and the piston being movable in response to fluid pressure to move the rocker arm into engagement with a second side of the rocker shaft, said second side being oriented substantially opposite to said first side, and the piston being slidable along an axis which extends through the pivot shaft.

6. The engine compression braking system of claim 5, wherein:

the rocker arm includes a tab which projects therefrom, the tab having a curved convex outer surface; and the piston having a curved concave surface which matingly engages the convex surface of tab.

7. An engine compression braking system comprising:

a rocker arm pivotally supported on a rocker shaft, the rocker arm having a pivot bore which receives the rocker shaft, the pivot bore having a diameter which is larger than a diameter of the pivot shaft;

a pressure responsive piston operatively engaging the rocker arm, the piston being slidable along an axis which extends through the pivot shaft; and a pressure control system for controlling fluid pressure applied to the piston, movement of the piston causing movement of a pivot axis of the rocker arm.

* * * * *